United States Patent [19]

Wahlberg

[11] 3,985,455

[45] Oct. 12, 1976

[54] CONVERTIBLE WRITING INSTRUMENT

[76] Inventor: Eric C. Wahlberg, 32 Eighth St., Stamford, Conn. 06905

[22] Filed: Jan. 10, 1975

[21] Appl. No.: 539,959

[52] U.S. Cl. ..... 401/30; 401/112

[51] Int. Cl.[2] ..... B43K 27/14

[58] Field of Search ..... 401/16–34, 401/112–114, 62, 82, 65

[56] References Cited

UNITED STATES PATENTS

| | | | |
|---|---|---|---|
| 1,479,996 | 1/1924 | Lundmark | 401/17 X |
| 2,883,968 | 4/1959 | Vertiz | 401/112 X |
| 2,926,630 | 3/1960 | Csaby | 401/82 X |
| 3,288,116 | 11/1966 | Poritz | 401/112 X |

*Primary Examiner*—Lawrence Charles
*Attorney, Agent, or Firm*—Alfred E. Miller

[57] ABSTRACT

A writing instrument having a plurality of writing medium assemblies which can be separated into a plurality of writing instruments each having at least one writing medium assembly. The writing instrument may include writing medium assemblies which are all retractable, all fixed or both retractable and fixed. Regardless of whether the writing instrument has a single or plurality of retractable writing medium assemblies, only one positioning device is required to position the writing medium assemblies in writing position.

5 Claims, 40 Drawing Figures

CONVERTIBLE WRITING INSTRUMENT

This invention relates to writing instruments, using a form of ink, having at least two writing medium assemblies which can be separated into two separate writing instruments each having at least one writing medium assembly. The writing medium assemblies may be of the type that can be retracted and replaced or are fixedly mounted in the writing instrument.

It is desireable at times to have a writing instrument which has more than one writing medium. Such occasion could be in accounting, editing or correcting papers where more than one color of ink is desireable to note separate conditions or to flag important information. Another occasion would be where there is more than one person working on a task with only one person having a writing instrument available. It would then be accommodating if the writing instrument would be capable of providing more than one writing instrument by a simple non-destructive separation of the writing instrument so that each person may be able to have the use of a writing instrument.

It is the object of this invention to provide a writing instrument having at least two separate writing medium assemblies which may be separated into at least two writing instruments each having at least one writing medium assembly.

It is an object of this invention to provide a writing instrument having at least two separate writing medium assemblies which may be either retractable and replaceable or fixed or both in the same writing instrument.

It is an object of this invention to provide a writing instrument which utilizes one positioning device to position all retractable writing medium assemblies in the same writing instrument individually.

It is a further object of this invention to provide a writing instrument which is formed from the union of at least two separate writing instruments each having at least one writing medium assembly.

Other objects of the invention will become apparent in reading the following description as it relates to the drawings of the several forms of an embodiment of the invention.

In the drawings

Figure 5:
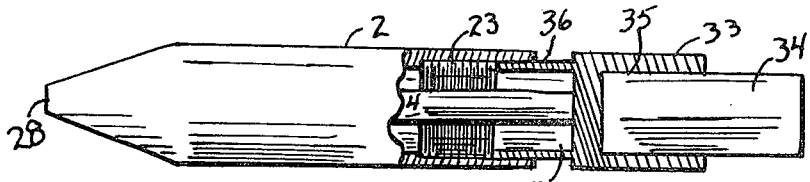
FIG. 5 is a fractured view of barrel 2 assembly of FIG. 1 with a writing medium assembly positioning cap attached to the open end.
Figure 1:
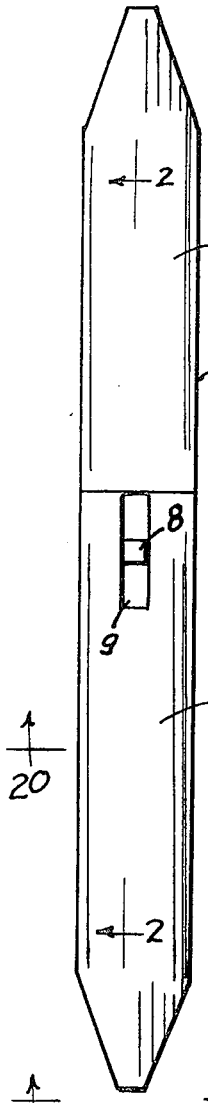
FIG. 1 is a view of a form of an embodiment of an assembly of the invention.
Figure 3:
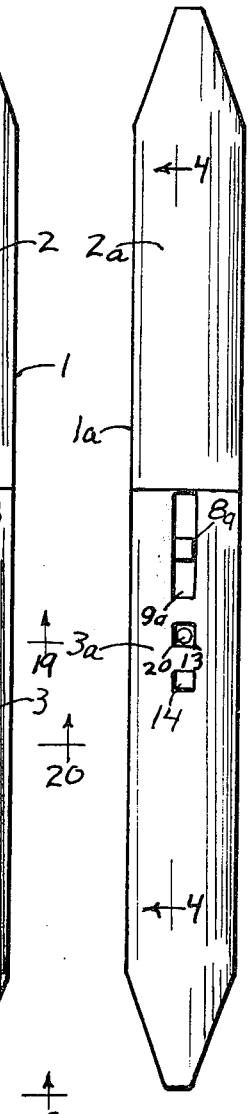
FIG. 3 is a view of a second form of the embodiment of the invention.
Figures 7, 8, 9, 10, 11, 12, 13, 14, 15, 16, 17, 18, 19, 20, 21, 22, 23, 24, 25, 26, 27, 28, 29:
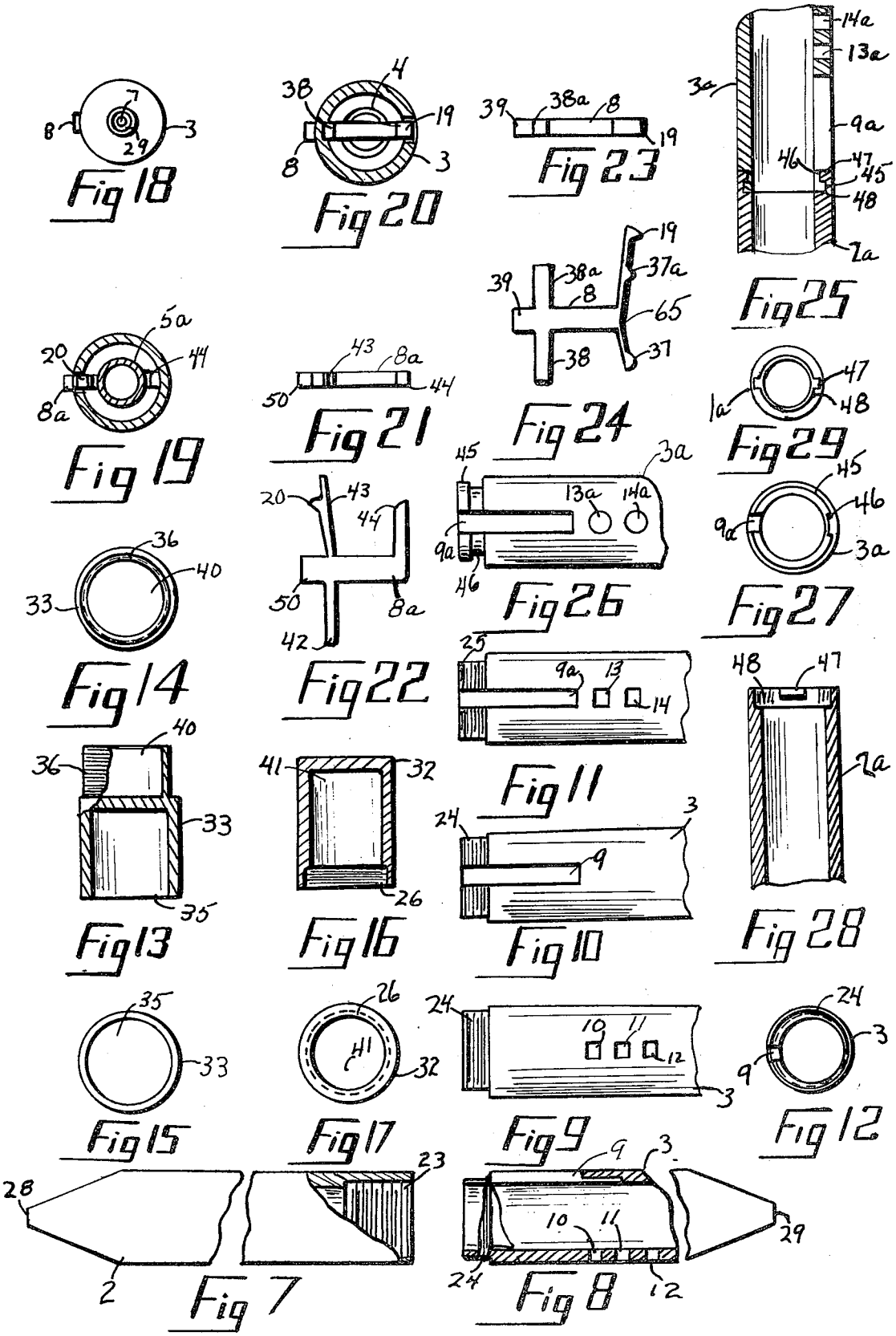
FIG. 7 is a fractured view of barrel 2 of FIG. 1.
FIG. 8 is a fractured view of barrel 3 of FIG. 1.
FIG. 9 is a view looking up at FIG. 8.
FIG. 10 is a view looking down on FIG. 9.
FIG. 11 is a partial view of barrel 3 of FIG. 3.
FIG. 12 is an end view of the threaded end of barrel 3 of FIG. 9.
FIG. 13 is a cross-section of cap 33 of FIG. 5.
FIG. 14 is an end view of threaded end of cap 33 of FIG. 13.
FIG. 15 is an end view of the unthreaded end of cap 33 of FIG. 13.
FIG. 16 is a cross-section of cap 32 of FIG. 6.
FIG. 17 is an end view of threaded end of cap 32 of FIG. 16.
FIG. 18 is an end view looking along line 18—18 of FIG. 1.
FIG. 19 is a cross-section taken along line 19—19 of FIG. 3.
FIG. 20 is a cross-section taken along line 20—20 of FIG. 1.
FIG. 21 is a view of actuator 8*a* of FIG. 3.
FIG. 22 is a bottom view of FIG. 21.
FIG. 23 is a view of actuator 8 of FIG. 1.
FIG. 24 is a bottom view of FIG. 23.

FIG. 25 is an alternate method of connecting Barrels 2 and 3 or 2*a* and 3*a* of FIGS. 1 and 3 respectively.

FIG. 26 is a view of barrel 3*a* looking at the right side of FIG. 25.

FIG. 27 is an end view of slotted end of barrel 3*a* of FIG. 26.

FIG. 28 is a cross-section of barrel 2*a* of FIG. 25 showing lug 47.

FIG. 29 is a top view of barrel 2*a* of FIG. 28.

Figure 30:
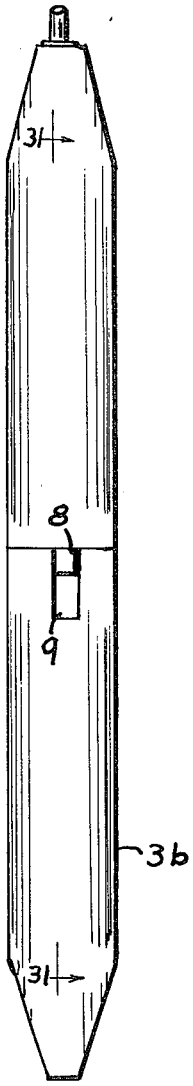

FIG. 30 is a view of another form of the embodiment of the invention.

Figure 31:
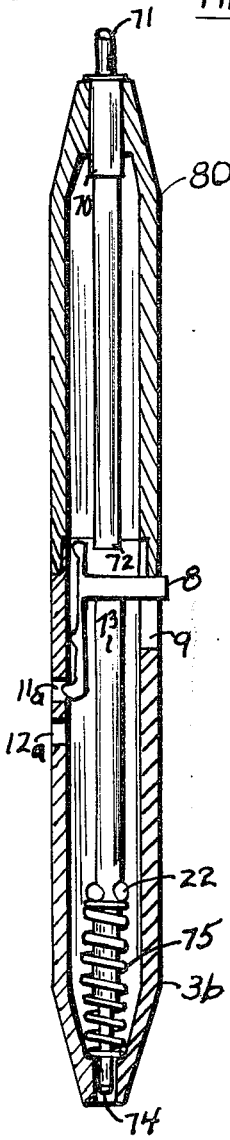

FIG. 31 is a cross-section taken along line 31—31 of FIG. 30.

Figure 32:
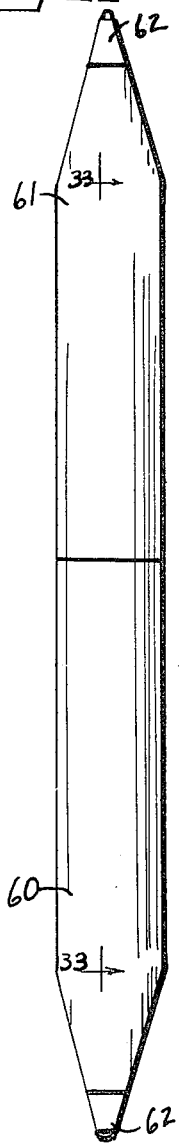

FIG. 32 is a view of still another form of the embodiment of the invention.

Figure 33:
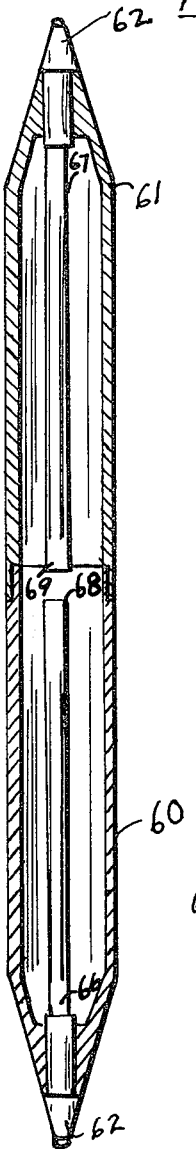

FIG. 33 is a cross-section taken along line 33—33 of FIG. 32.

Figure 34:
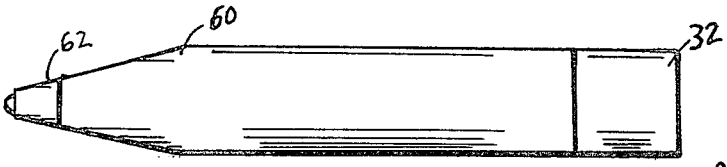

FIG. 34 is a view of a single writing instrument made from either part 60 or 61 of FIG. 33 or upper part 80 of FIG. 31.

Figure 2:
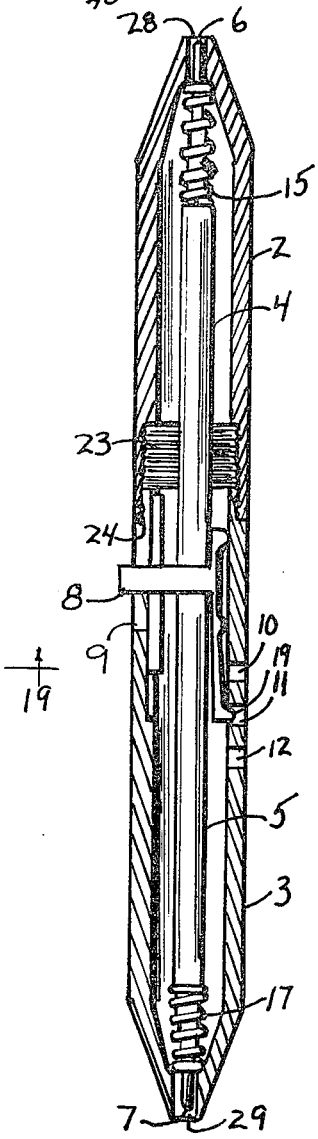
FIG. 2 is a cross-section taken along lines 2—2 of FIG. 1.
Figure 4:
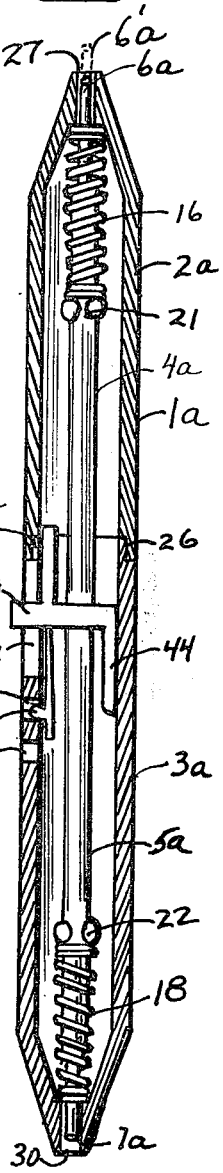
FIG. 4 is a cross-section taken along line 4—4 of FIG. 3
Figure 6:
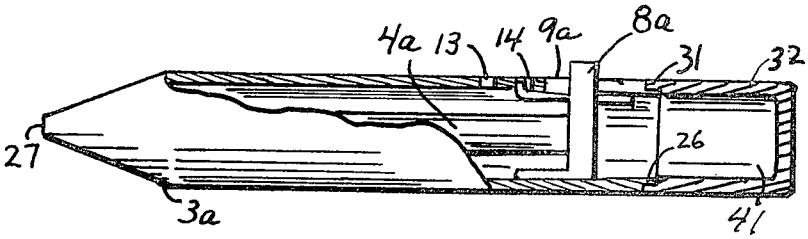
FIG. 6 is a fractured view of barrel 3*a* assembly of FIG. 3 with a cap attached to the open end of the barrel.
Figure 35:
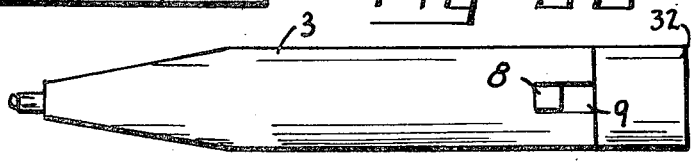

FIG. 35 is a view of a single writing instrument made from the lower part 3*b* of FIG. 31 or lower part 3 of FIG. 2.

Figure 36:
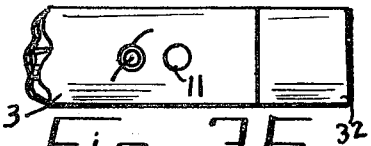

FIG. 36 is a partial view of FIG. 35 rotated 180°.

Figure 37:
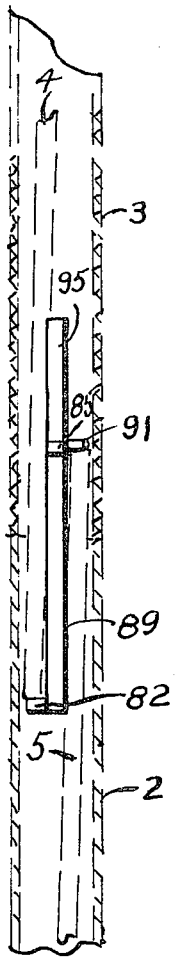

FIG. 37 is a view of another form of the writing medium assembly positioning means in a phantom barrel.

Figure 38:
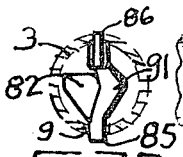

FIG. 38 is an end view of the positioning means of FIG. 37.

Figure 39:
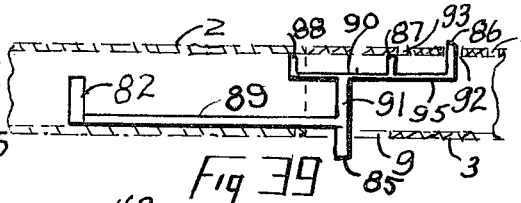

FIG. 39 is a side view of the positioning means looking from the left side of FIG. 37.

Figure 40:
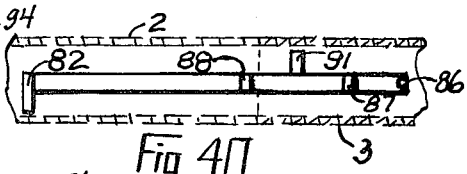

FIG. 40 is a top view of FIG. 39.

FIGS. 1, 2 5–9, 12, 18, 20, 23 and 24 refer to one form of the embodiment of the invention as a multiple writing medium assembly writing instrument.

FIGS. 3–7, 11, 18, 19, 21 and 22 refer to a second form of the embodiment of this invention as a multiple writing medium assembly writing instrument.

FIGS. 5, 13–15 refer to a representative assembly of the form of the embodiment as a single writing instrument made from the multiple writing medium assembly writing instrument using barrels 2 and 2*a*.

FIGS. 6, 11, 17, 19, 21 and 22 refer to a representative assembly of the form of the embodiment as a single writing instrument with barrel 3 or alternately barrel 3*a*.

FIGS. 25–29 refer to an alternate mode of connecting barrels 2, 2*a* with 3, 3*a* respectively.

FIGS. 32, and 33 refer to an alternate assembly of the embodiment of the invention consisting of fixedly mounted writing medium assemblies.

FIGS. 30 and 31 refer to another assembly consisting of one fixedly and one retractably mounted writing medium assemblies.

FIGS. 34–36 represent single writing medium assembly writing instrument made from multiple writing medium assembly writing instrument of FIGS. 30–33 respectively.

FIGS. 37–40 represent a form of the writing medium assembly positioning device which may be used for positioning overlapping writing medium assemblies in a convertible writing instrument.

The writing medium assembly positioning device 85 of FIGS. 37–40 consists of a flexible bridge 90 and its extension 95 with a first projection 88 located at one end of the bridge 90 and a second projection 87 located along the bridge 90. A positioning projection 86 is located on the end of the extension 90. A positioning arm 85 extends from the bridge 90 midway between projections 87 and 88 and in a direction opposite to that of the projections 87 and 88. A portion 91 of the positioning arm 85 is used to co-act with one writing medium assembly 5 to extend it into writing position in barrel 2. A stabilizing arm 89, which contacts the inside wall of the barrel 2 is also used to connect the positioning arm 85 with a member 82 which serves to co-act with the second writing medium assembly 4 to extend it into writing position in barrel 3. Positioning projection 86 co-acts with positioning holes 92, 93, 94 in barrel 3. The positioning hole 92 represents the retracted or neutral position for both writing medium assemblies 4, 5. The positioning hole 93 represents the extended or writing medium assembly 5; positioning hole 94 represents the extended or writing position of writing medium assembly 4 when positioning projection 86 co-acts with each respectively. The slot 9 in barrel 3 is opposite to that of the positioning holes 92, 93, 94 and accommodates and substantially limits the motion of the positioning device 85 to the distance of holes 93 and 94. The operation of moving the positioning device using the flexible bridge and projections to position the writing medium assemblies in writing position as dictated by the several positioning holes is further described hereinafter.

Referring now to the first form of the embodiment (FIGS. 1 and 3), there are two barrels 2 and 3 which are threaded together by means of thread 23 in barrel 3 and thread 24 in barrel 2. A writing medium assembly 4 is spring biased inwardly and moveably mounted in barrel 2. A writing medium assembly 5 is spring biased inwardly and moveably mounted along axis in barrel 3. Placed between the non-writing ends of the two writing medium assemblies is a positioning device 8 having a flexible bridge 65 with a projection 37 located on one end of the bridge 65 and another projection **37*a* located along the bridge 65. A positioning projection 19 is located at the other end of the bridge 65. A positioning arm 30 extends from the bridge 65 midway between projections 37 and 37*a* and in a direction opposite to that of the projections 37, 37*a*. Stabilizing arms 38 and 38*a* contact the inside wall of barrel 3 while positioning projection 19 cooperates with positioning holes 11 and alternately 10 or 12 in barrel 3. The positioning hole 11 represents the retracted position of writing medium assemblies 4 and 5. Positioning hole 10 represents the extended or writing position of writing medium assembly 4 and positioning hole 12 represents the extended or writing position of writing medium assembly 5 when positioning projection cooperates with each respectively. Slot 9 in barrel 3 is opposite to that of the positioning holes 10, 11, 12 and accommodates and limits the motion of positioning device 8. The positioning arm 39 may be moved by depressing it. This flexes the portion of the flexible bridge 65 between the two projections 37 and 37*a* toward the wall of the barrel 3. This action causes the rest of the bridge 65 to move inwardly from the barrel wall thus causing the positioning projection 19 to leave the positioning hole 11 it is in. The positioning arm may now be moved to any other positioning hole and, when the positioning arm is released, the flexible bridge will return to its normal position and the positioning projection 19** inserted into a desired positioning hole in the barrel wall. Thus the positioning device may be moved into any position to thereby position the writing medium assemblies.

A "Flair" refill writing medium assembly could replace the ball point writing medium assembly 5 to provide a porous tip or felt tip pen which would look essentialy the same as that of FIGS. 1 and 2 by placing the bias spring of the ball point writing medium assembly 5 on the "Flair" writing medium assembly in the barrel 3 as described above.

The writing instrument described may be made into two writing instruments by uncoupling the two barrels 2 and 3 and coupling the cap 32 to the barrel 3 in place of barrel 2. This cap serves to limit the travel of positioning device 8 in the same manner as barrel 2 and to complete the assembly of the single writing medium writing instrument. The cap 32 has a thread 26 which is compatible with thread 23 of barrel 3. Coupling of cap 33 to barrel 2 in place of barrel 3 completes the second single writing instrument. This cap 33 serves to extend or retract the writing medium assembly 4 by threading the cap 33 into or out of barrel 2 by means of thread 36 in cap 33 and thread 26 in barrel 2. The separating wall between the hollow cylinders 35 and 40 of cap 33 serves as the contact with the medium assembly 4. Threading the cap 33 into the barrel 2 extends the writing medium assembly 4 out of the barrel while threading the cap 33 out of the barrel 2 allows bias spring 15 to retract the writing medium assembly into the barrel 2. The hollow cylinder 35 part of the cap 33 can be used for holding an eraser 34 or other design or ornament. Cap 33 can be used without the hollow cylinder 35 which would make it look substantially like cap 32 when assembled to the barrel 2.

Coupling of the barrels 2 and 3 may be accomplished by other means than threads such as illustrated in FIGS. 25–28 where prongs 47 extend inwardly from groove 48 of one barrel **2*a* to cooperate with groove 46 in the other barrel 3*a* and flange 45. The prongs 47 are inserted into slot 9*a* and 46 and then turned so that prongs 47 are captured in groove 46 and held there by rim 45.**

The second form of the embodiment comprises two barrels **2*a* and 3*a* assembled in the same manner as described above and having the same components except for the positioning device as described above. The positioning device 8*a* as used in this form of the embodiment consists of a flexible arm 43 extending from positioning arm 39 with a positioning projection 20 extending from the end of the flexible arm 43. A guide arm 42 also extends from the positioning arm 50 but in a direction opposite to that of the flexible arm 43. Another guide arm 44 may extend from the end of the positioning arm 50. The guide arms 42 and 44** cooperate with diametrically opposite inside surfaces of barrel 3*a* while positioning arm 50 is restricted in motion and guided by slot 9*a*. For ease of operating the positioning device the positioning arm extends beyond the outside of the barrel surface. The positioning projection 20 cooperates with positioning holes 13, 14 and slot 9*a* all of which are substantially in line, when positioning arm 50 is moved in slot 9*a*. This form of the embodiment may be made into two single writing medium assembly writing instruments in the same manner as described herein previously.

A further embodiment form (FIGS. 32 and 33) is one in which two writing medium assemblies 66 and 67 are used which are fixedly mounted in barrels 60 and 61 respectively and barrels coupled together in a manner such as previously described. These writing medium assemblies 60 and 61 are standard and consist of fluid reservoir tubes 68 and 69 respectively and ball point assembly 62. These assemblies are inserted from the tapered ends of the barrels 60 and 61 respectively. There is no positioning device required in this form in which the writing assembly is always in fixed writing position. Here, again, the writing medium assemblies may be separated and made into separate writing instruments as described above with each one having a single writing medium assembly.

Still a further form of the embodiment (FIGS. 30 and 31) is one in which one writing medium assembly 70 is mounted fixedly in one barrel 80 and the other writing medium assembly 73 is moveably and retractably mounted in the other barrel 3*b*. The fixedly mounted writing medium assembly 70 consists of reservoir 72 and ball point assembly 71. This writing medium assembly is inserted into the tapered end of barrel 80. The standard retractable assembly 73 consists of a reservoir having ears 22 which control the position of bias spring 75 as shown and, a ball point assembly 74. This writing medium assembly is inserted into the open end of barrel 3*b*. The structure and positioning of both the fixedly mounted and moveably or retractably mounted writing medium assemblies have been described above wherein the positioning device 8 is used to extend the writing medium assembly 73 into writing position and wherein the fixedly mounted writing medium assembly 70 is always in writing position. This form may also be made into two separate writing instruments (FIGS. 34 and 35) in the same manner as noted above.

It is conversely true that a writing instrument having at least two writing medium assemblies may be assembled from two writing instruments having a single writing medium assembly each (FIGS. 5, 6, 34 and 35) provided they have mating coupling means. By removing the cap 32 from writing instrument of FIG. 6 and cap 33 from FIG. 5, these two instruments may be coupled together to form a single writing instrument having two writing assemblies which are retractable and replaceable. Similarly, cap 32 of FIG. 35 and cap 33 of FIG. 5 may be removed and the two writing instruments coupled together to form a single writing instrument having one retractable and replaceable and one fixed writing medium assemblies.

To assemble the writing instrument 1, the writing medium assembly 5 including bias spring 17 is inserted into barrel 3. The positioning device 8 is assembled behind the writing medium assembly 5 with the projection 19 located inwardly of the rest of the device and the positioning arm 39 located in the slot 9 of the barrel 3. The writing medium assembly 4 is placed in barrel 2 and the two barrels coupled together by their mating threads. Thus the positioning device 8 is captured into position in slot 9 by the coupling end of barrel 2. All of the embodiments employing retractable writing assemblies are assembled in a similar manner. Fixedly mounted writing medium assemblies are press fitted into the tapered end of their respective barrels.

There has accordingly been described and shown a writing instrument having at least two writing medium assemblies which can be separated into a plurality of writing instruments each having at least one writing medium assembly which can be retracted or fixed in the writing instrument. Additionally, there has been described a writing instrument having at least two writing medium assemblies which may all be retractable, some retractable and the rest fixedly mounted, or all may be fixedly mounted. Furthermore, there has been described and shown that two writing instruments each having at least one writing medium assembly may be coupled together to make a writing instrument having at least two writing medium assemblies which may be either all retractable, some retractable and the rest fixedly mounted, or they may be all fixedly mounted. Still further, there has been described the use of more than one type of writing medium and more than one type of positioning device for positioning the retractable writing medium assembly. There has also been described and shown that the embodiment is simple in operation and in construction with replaceable and interchangeable parts for relatively inexpensive manufacture and maintenance.

While the foregoing disclosure has been primarily concerned with exemplary forms of the invention, it is to be understood that the invention is susceptible of many modifications in construction and arrangement as well as variation of alternate parts.

The present invention, therefore, is not to be considered as limited to the specific disclosure provided herein, but is to be considered as including all modifications and variations coming within the scope of the invention as defined in the appended claims.

What I claim is:

1. A convertible writing instrument comprising a first writing instrument including a first barrel having an aperture in a tapered end and a coupling means in the opening of the other end, a second barrel having an aperture in a tapered end, and a coupling means compatible with said coupling means of said first barrel in the opening of the other end, said first and second barrels being united by engagement of said coupling means of said first and second barrels, at least one writing medium assembly positioned in said first barrel, at least one writing medium assembly positioned in said second barrel, a writing medium assembly positioning means of said first writing instrument located in said opening of the first barrel and co-acting with said writing medium assembly of said first writing instrument to position said retractable and replaceable writing medium assembly in writing position through said aperture or in the retracted position in said first barrel, said first barrel further including positioning holes, a writing medium assembly positioning means positioned in said first barrel co-acting with said writing medium assembly in said first barrel, said writing medium assembly positioning including a flexible bridge with a first projection at one end, a positioning projection at the other end, a second projection between said first and positioning projection, a positioning arm for actuating said writing medium assembly positioning means extending from said flexible bridge midway between said first and second projections in a direction opposite to said first and second projections, said positioning arm extending out of a slot in said wall of the open end of the barrel, said positioning projection of said flexible bridge co-acting with at least one of said positioning holes.

2. A convertible writing instrument as recited in claim 1 wherein said second barrel coupling means locks said writing medium assembly positioning means into operating position in said first barrel.

3. A convertible writing instrument as recited in claim 1 wherein said retractable and replaceable writing medium assembly in said first writing instrument is assembled into said first barrel from said open end of said barrel and said second barrel coupling means in said third instrument locks said writing instrument medium assembly positioning means into operating position in said first barrel.

4. A convertible writing device comprising:

a. a first writing instrument including a first barrel having one end tapered and provided with an aperture, the other end being open, a coupling means at the open end of said first barrel, at least one replaceable and retractable writing medium assembly inserted through said open end of the first barrel and extending out said aperture into a writing position, a writing medium assembly positioning means located in said opening for positioning said writing medium assembly in writing position through said aperture or in a retracted position within said first barrel, a first cap having a coupling means compatible with said coupling means of said first barrel to lock said writing medium positioning means into operating position in said first barrel;

b. a second writing instrument including a second barrel having one end tapered and provided with an aperture, the other end being open, a coupling means at the open end of said second barrel, at least one writing medium assembly inserted through said open end of said second barrel and having its writing means extending out of said aperture into writing position; a second cap having a coupling means compatible with said coupling means of said second barrel;

c. a third writing instrument including said first writing instrument without said first cap coupled to said second writing instrument without said second cap by means of engagement of said coupling means of said first barrel of said first writing instrument with said coupling means of said second barrel of said second writing instrument; and d. said writing medium assembly positioning means including a flexible bridge with a first projection at one end, a positioning projection at the other end, a second projection between said first and positioning projection, a positioning arm for actuating said writing medium assembly positioning means extending from said flexible bridge midway between said first and second projections in a direction opposite to said first and second projections, said positioning arm extending out of a slot in said wall of the open end of the barrel, positioning holes in the wall of said barrel, said positioning projection of said flexible bridge co-acting with least one of said positioning holes.

5. A convertible writing instrument as recited in claim 4 wherein the respective writing medium assembly is assembled through the open end of the respective barrel into suspended mounting within said barrel.

* * * * *